US005596985A

United States Patent [19]

Collier

[11] Patent Number: 5,596,985

[45] Date of Patent: Jan. 28, 1997

[54] SURGICAL MASK

[76] Inventor: John M. Collier, 1417 Buckingham, Grosse Pointe Park, Mich. 48230

[21] Appl. No.: 594,838

[22] Filed: Jan. 31, 1996

[51] Int. Cl.[6] ..... A62B 7/10

[52] U.S. Cl. ..... 128/206.19; 128/201.29; 128/205.25; 128/206.12; 128/206.21; 128/206.28; 2/9

[58] Field of Search ..... 128/206.19, 202.19, 128/202.29, 205.25, 205.29, 206.12, 206.13, 206.21, 206.25, 206.26, 206.27, 206.28, DIG. 24, 201.29, 863, 201.13, 201.17, 206.22; 2/9, 48, 49.1

[56] References Cited

U.S. PATENT DOCUMENTS

| | | | |
|---|---|---|---|
| 152,215 | 6/1874 | Crofutt | 128/206.19 |
| 1,150,991 | 8/1915 | Britton | 128/206.19 |
| 2,515,009 | 7/1947 | Hyghlago | 128/206.19 |
| 2,818,857 | 1/1958 | Wilkins et al. | 128/206.28 |
| 3,058,463 | 10/1962 | Goodrich, Jr. | 128/863 |
| 4,019,508 | 4/1977 | Der Estephanian | 128/206.12 |
| 4,038,979 | 8/1977 | McCosker | 128/206.12 |
| 4,055,173 | 10/1977 | Knab | 128/201.29 |
| 4,411,023 | 10/1983 | Pinson | 2/7 |
| 4,419,993 | 12/1983 | Petersen | 128/201.15 |
| 4,589,408 | 5/1986 | Singer | 128/206.19 |
| 4,635,628 | 1/1987 | Hubbard et al. | 128/206.19 |
| 4,657,010 | 4/1987 | Wright | 128/205.25 |
| 4,920,960 | 5/1990 | Hubbard et al. | 128/206.12 |
| 4,969,457 | 11/1990 | Hubbard et al. | 128/206.12 |
| 4,969,473 | 11/1990 | Bothwell | 128/858 |

*Primary Examiner*—V. Millin
*Assistant Examiner*—V. Srivastava
*Attorney, Agent, or Firm*—Thomas, Kayden, Horstemeyer & Risley

[57] ABSTRACT

The surgical mask (10) protects a wearer's face, neck and upper chest region from exposure to bodily fluids expelled by a patient and includes an upper mask (12) resistant to fluids yet permeable by ambient gases for covering the wearer's nose and mouth, a fluid-proof lower mask (14) of greater breadth than the upper mask which is attached to the upper mask and extends circumferentially beyond the upper mask and hangs freely therefrom downwardly to the wearer's torso to provide a fluid barrier, and tie strings (18, 20) are attached to the upper mask for fastening the upper mask about the wearer's head. The lower tie strings (24) are connected to the lower mask and support the laterally extending upper side portions (25) of the lower mask about opposite sides of the neck of the wearer.

7 Claims, 2 Drawing Sheets

SURGICAL MASK

TECHNICAL FIELD

This invention relates to surgical masks generally and more particularly to masks worn by dentists and surgeons to protect their necks and upper chest areas from contact by a patient's bodily fluids.

BACKGROUND ART

Various types of masks are available for preventing inhalation by the user of harmful substances such as chemicals or dust in a manufacturing environment. These masks typically are constructed of one or more layers of a material which filters out larger particles but allows respiration of the user.

Some of the masks are used in a hospital or surgical environment primarily to shield a patient from water or airborne bacteria emanating from a doctor's mouth.

The emphasis on protecting the doctor has increased in recent years with the knowledge that acquired immune deficiency syndrome ("AIDS") is communicated via exchange of body fluids, primarily blood. Studies show that dental surgeons are at high risk because pathogens that may spread from the oral cavity include the influenza, rabies, and hepatitis viruses and HIV. U.S. Pat. No. 4,920,960 discloses a body fluid barrier mask for covering only the mouth and nose of a wearer.

Other prior art masks have been disclosed which extend downwardly from an upper mask portion so as to cover the front of the abdomen of the wearer. However, there remains a need for a light weight mask that covers the face of the physician as well as the front and sides of the neck and the front upper torso, but which is easy to don and which does not encumber movement of the wearer.

DISCLOSURE OF INVENTION

It is an object of the present invention to provide a surgical mask which will protect the neck and upper chest region of the wearer from contact with a patient's bodily fluids.

It is a further object of the present invention to provide such a surgical mask which is unobtrusive to the wearer and provides complete freedom of motion during operations and other medical procedures.

Still another object of the invention is to provide such a surgical mask that keeps bodily fluids and other biological debris from entering clothing of the wearer.

In carrying out the above objects and other objects of the invention, the surgical mask includes an upper mask coveting the wearer's nose and mouth. The upper mask is resistant to fluids yet permeable by ambient gases to permit breathing. A fluid-proof lower mask is attached to the upper mask. The lower mask is connected to the upper mask and extends circumferentially on opposite sides beyond the upper mask and hangs freely from the upper mask downwardly to the wearer's torso. The fluid-proof lower mask provides a fluid barrier to the wearer's neck and upper torso and allows unobstructed rotation and inflection of the wearer's head. Straps are attached to the upper mask and fasten the upper mask about the wearer's head.

In the preferred embodiments the upper portion of the lower mask is of greater breadth than the upper mask so that the lower mask extends laterally on opposite sides of the upper mask to reach about opposite sides of the wearer's neck.

In the preferred embodiment, the upper mask comprises a layered material resistant to fluid from outside the mask. Ties extending along the top of the upper mask and along the bottom of the upper mask are tieable to fasten the mask to the wearer. The bottom of the upper mask and top of the fluid-proof lower mask are seamed along the lower ties.

In the preferred embodiment, the lower mask comprises a material composed of a plastic-backed paper. The lower mask also includes a plurality of vertical pleats to reduce blousing and to allow the wearer complete freedom of rotation and flection beneath the fabric while maintaining protection of the wearer's neck and torso.

In an alternative embodiment of the invention, a fastener such as two-sided tape is mounted generally about the inside of the bottom edge of the fluid-proof lower mask to attach the fluid-proof lower mask to a garment worn by the mask wearer.

The above objects and other objects, features, and advantages of the present invention are readily apparent from the following detailed description of the best mode for carrying out the invention when taken in connection with the accompanying drawings.

DETAILED DESCRIPTION

Figure 1:
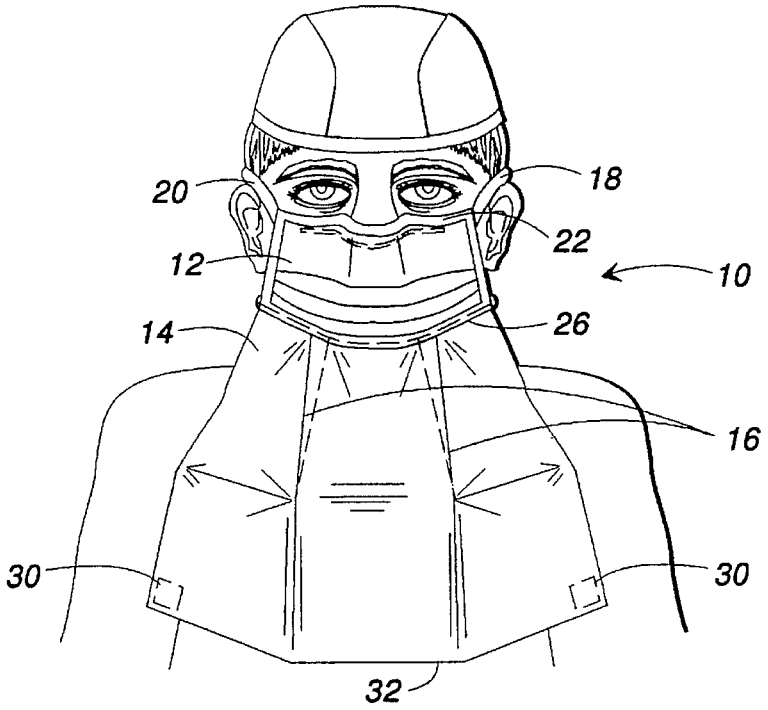
FIG. 1 is a front elevational view of a surgical mask constructed in accordance with the present invention being worn by a wearer.
Figure 2:
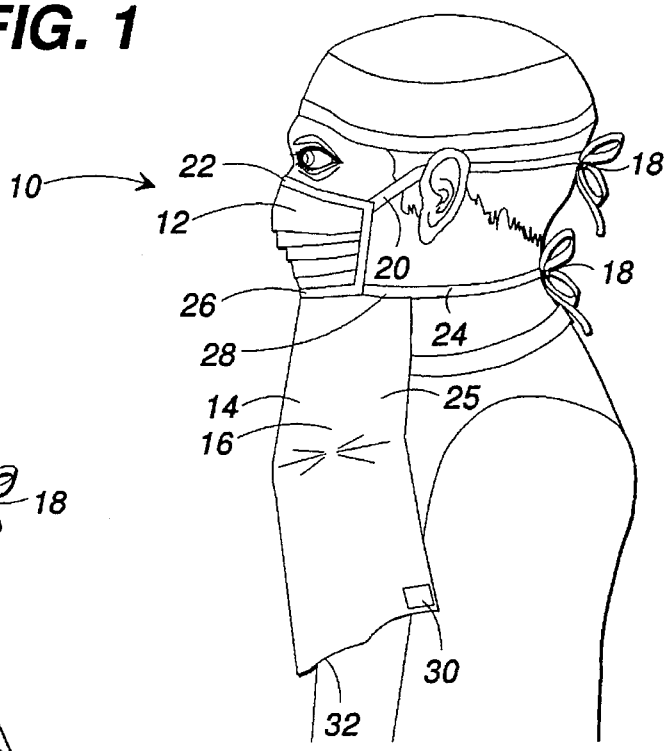
FIG. 2 is a side elevational view of the surgical mask and wearer.

Referring to FIGS. 1 and 2, a surgical mask constructed in accordance with the present invention is generally indicated by reference number 10 and is worn by a doctor, or other operating personnel, to protect the wearer's face, neck and upper chest region from contact with a patient's bodily fluids which may result during a surgical procedure or treatment.

The mask 10 includes an upper portion which is the upper face mask 12 that protects both patient and doctor. The upper mask 12 covers the doctor's nose and mouth and is composed of layers of faltering material. This faltering material is resistant to fluids yet permeable by ambient gases. The faltering material permits breathing but prevents bacteria from breaching the barrier, thereby protecting the patient from infection during various medical procedures. Similarly, the fluid resistant nature of the filtering material prevents the patient's bodily fluids from reaching the doctor. This is particularly important during invasive procedures when the patient's blood may splatter.

A fluid-proof lower portion or lower neck and chest mask 14 is attached to the upper mask 12. As illustrated in FIGS. 1 and 2, lower mask 14 extends circumferentially beyond the upper mask 12 and hangs freely downwardly covering the wearer's neck and upper chest region. In contrast to the upper mask 12, the lower mask 14 is totally impervious to liquids and gases for the benefit of the doctor against splashing of blood or other body fluids. Preferably, the lower mask 14 comprises a paper material, on the side facing the patient, and a flexible plastic coating on the side adjacent the wearer or back side. The paper on the front eliminates splashing and drips by absorbing liquids that contact the paper. The plastic layer is a barrier to the liquids.

The lower mask 14 is intended to protect the doctor's neck and upper torso. The need for this has arisen in recent years due to the outbreak of the AIDS virus. While skin has been thought to be an adequate barrier to the virus, daily shaving tends to create microscopic cuts which could serve as passageways for the virus.

The lower mask 14 provides an effective barrier and its design makes it unobstructing to the wearer. The lower mask 14 is wider than the upper mask 12 and extends circumferentially 2 to 4 inches laterally beyond the upper mask 12. A pair of vertical pleats 16 provides structural integrity to the lower mask 14 and prevents blousing of the material in the region of the chin and neck. Due to the pleating and manner of stitching to the upper mask, the lower mask easily conforms to a circumferential shape surrounding the wearer's chin and neck.

In the preferred embodiment, both upper and lower masks 12, 14 are secured by tie straps 18 tieable behind the wearer's head. A first pair 20 is attached near the top edge 22 of the upper mask 12 and a second pair 24 of straps 18 is attached to the lower edge 26 of the top mask 12 and also to the top edge 28 of the lower mask where the two masks are joined, preferably by stitching 29. The lower mask 14 hangs freely therefrom.

In use, the upper mask 12 remains securely fastened about the wearer's nose and mouth while the lower mask 14 allows the wearer to freely rotate and flex his/her head beneath the fabric. Because the lower mask 14 is fastened only at its top edge 28, it is free to move along with the user's torso. It will not bind, for instance, if the user must bend at the waist or turn his or her head up to 90° to either side.

With further reference to FIGS. 1 and 2, the mask 10 may include a fastener 30 located on the inside surface of the lower mask 14 to attach the lower mask to a garment of the wearer; this also keeps bodily fluids and other biological debris from entering the clothing of the wearer. Preferably, fastener 30 is two-sided tape mounted along the bottom inside edge 32 of lower mask 14.

Figure 4:
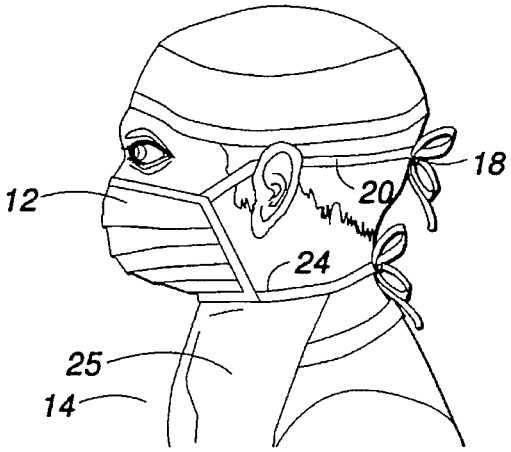
FIG. 4 is a side elevational view of the surgical mask, similar to FIG. 2, but illustrating how the mask can be tied under the chin of the wearer and the sides of the lower mask can extend farther about the sides of the neck of the wearer.

FIG. 4 of the drawings illustrates the lower portion of the upper mask being drawn farther beneath the chin of the wearer by the lower draw strings 24. When the mask is worn in this manner, the lower mask is drawn farther toward the front of the neck of the wearer, and the side edge portions 25 of the lower mask are drawn farther rearwardly about the neck and, to some extent, over the upper shoulders of the breast of the wearer. The lower mask then becomes draped somewhat like a bib at the front of the wearer, so that when the head of the wearer is turned left or right, the lower mask does not tend to become displaced from its protective position in front of the wearer.

Figure 3:
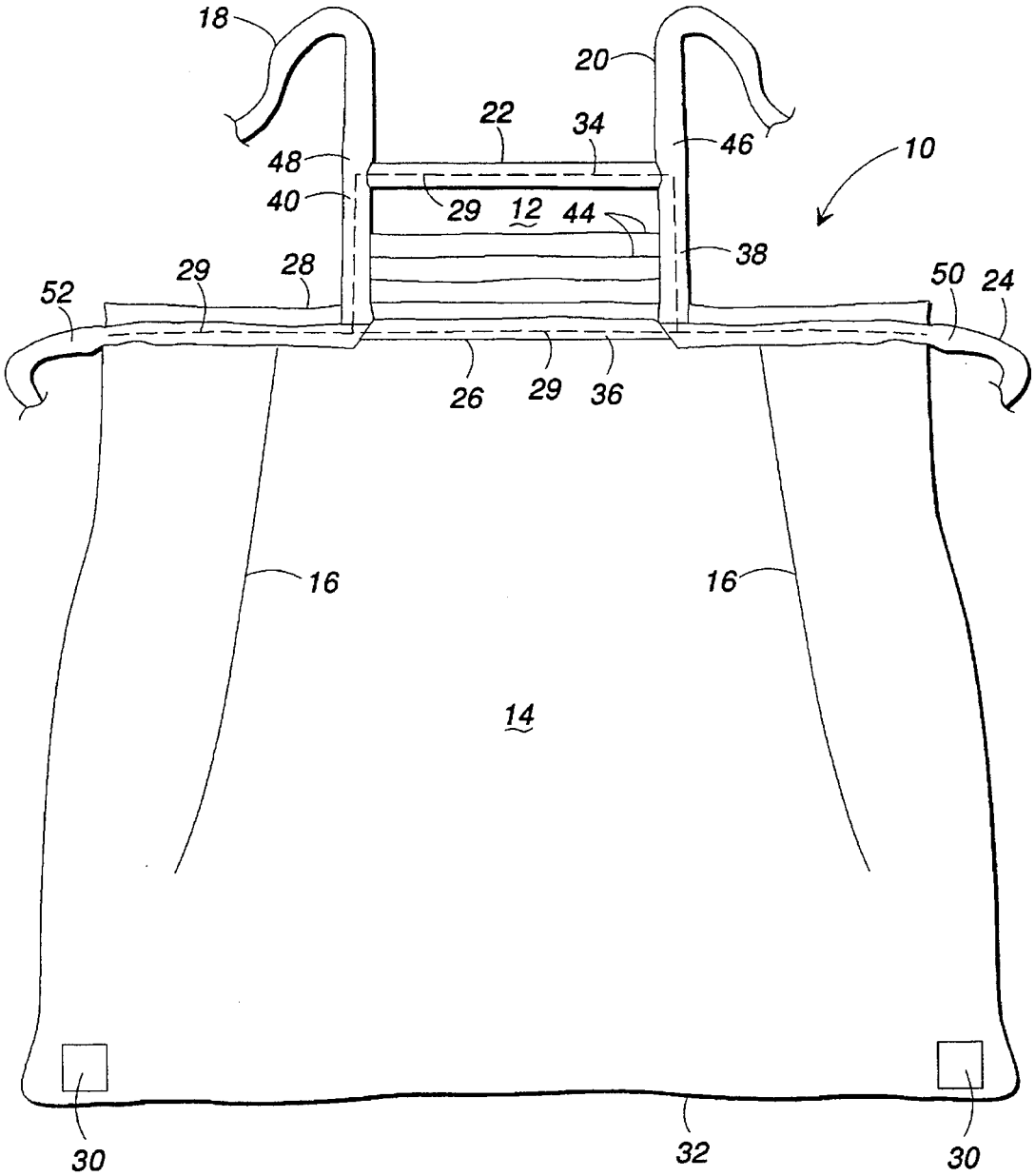
FIG. 3 is a front elevational layout view of the mask.

FIG. 3 illustrates the details of construction of the mask. The tie strings 18 are arranged in segments about the upper mask and along the upper edge of the lower mask. More specifically, the tie strings 18 are formed of flat material, and the material is folded about all of the edges of the upper mask. An upper horizontal tie string segment 34 is folded about the upper edge 22 of the sheet material that forms the upper mask 12 and is stitched thereto with stitches 29. Likewise, a lower horizontal segment 36 of tie string material is folded about the lower edge of the upper mask and stitched thereto. Opposed side segments 38 and 40 of tie string material are folded about the side edges of the upper mask and sewn thereto. The upper and lower horizontal segments and the opposed side segments 34, 36, 38 and 40 therefore form a generally rectangular frame for supporting the material of the upper mask, and this frame of tie strings reinforces the upper mask so that the upper mask does not tend to lose its shape. A series of pleats 44 are folded into the material of the upper mask and are retained in the material by the reinforcement of the opposed side segments of tie string material.

Tie string segments 46, 48, 50 and 52 are each attached to the comers of the upper mask, being attached to the intersections of the horizontal segments of tie string 34 and 36 with the opposed side segments 38 and 40. Upper tie string segments 46 and 48 are free and are available for being extended rearwardly about the wearer's head and to be tied at their ends behind the wearer's head. Lower tie strings 50 and 52 are sewn by stitching 29 to the upper lateral portions 25 of the lower mask 14, and then extend beyond the lower mask so as to be available for surrounding the neck of the wearer and being tied behind the neck of the wearer.

It will be noted from FIGS. 2 and 4, the lower tie strings 50 and 52 control the shape of and position of the upper portion of the lower mask, supporting the upper portion of the lower mask generally beneath the ears of the wearer, to draw the upper mask toward a position immediately adjacent the neck of the wearer, beneath the chin of the wearer and to extend the side portions 25 of the lower mask about the sides of the neck of the wearer. The positioning of the lower mask rearwardly beneath the chin minimizes the amount of movement of the lower mask when the surgeon talks or otherwise moves his or her lower jaw and minimizes the movement of the lower mask when the surgeon moves his or her head by rotating the head or tilting the head.

While the best mode for carrying out the invention has been described in detail, those familiar with the art to which this invention relates will recognize various alternative designs and embodiments for practicing the invention as defined by the following claims.

I claim:

1. A surgical mask to be worn by a medical attendant, for wearing about the nose, mouth, lower face and frontal neck and upper torso of the wearer for protecting the wearer from exposure to the body fluids expelled from a patient, comprising:

an upper mask for coveting the wearer's nose, mouth and chin, said upper mask including a segment of sheet material formed of air permeable material to permit the wearer to breathe through the upper mask while protecting the nose and mouth of the wearer from fluids expelled from a patient and having an upper edge portion for placement across the bridge of the wearer's nose and a lower edge portion for placement under the chin of the wearer, and opposing side portions intersecting said upper edge portion and said lower edge portion for extending about the cheeks of the face of the wearer;

an upper tie string means fastened to said upper mask at the upper edge portion of said upper mask with said upper tie string means having end portions freely extending from said upper mask for extending over the ears and about the head of the wearer a distance sufficient to be tied together behind the head of the wearer;

a lower tie string means fastened to said upper mask at the lower edge portion of said upper mask, with said lower tie string means having end portions extending from said upper mask for extending beneath the ears and about the neck of the wearer a distance sufficient to be tied together behind the neck of the wearer;

a lower mask for coveting the wearer's neck and frontal torso, said lower mask including a segment of sheet material formed of fluid impervious material for protecting the wearer from exposure to body fluids expelled from a patient, said lower mask having an upper edge portion for placement beneath the chin of the wearer and a lower edge portion for placement at the front torso of the wearer, and side portions sized and shaped for extending about the sides of the neck and upper torso of the wearer;

the upper edge portion of said lower mask being connected at said lower tie string means and to the lower portion of said upper mask for forming a continuous shield from the nose downwardly to the torso of the wearer;

said upper edge portion of said lower mask extending along said lower tie string means farther than the lower edge portion of said upper mask on opposite sides of said upper mask, with the lower tie string means arranged for suspending the side portions of said lower mask about the opposite sides of the neck of the wearer and across the breast of the wearer to protect the front and sides of the wearer's neck and the breast of the wearer from fluids expelled from a patient.

2. The surgical mask of claim 1 and wherein the segment of sheet material which forms said upper mask is shaped in a series of pleats extending laterally between said side portions so that the pleats can open to permit the lower edge portion of the upper mask and the upper edge portion of the lower mask to be supported beneath the chin and close to the neck of the wearer with the side edges of the lower mask drawn close about the sides of the neck of the wearer.

3. The surgical mask of claim 1 and wherein the sheet material of said lower mask includes pleats extending from said lower tie string means, and the lower edge portion of said lower mask is of larger breadth than the upper portion of said lower mask.

4. The surgical mask of claim 1 and further including tie string means extending across the entire upper edge portion of said lower mask and across the entire lower edge of the upper mask for retarding lateral stretching of the upper and lower masks with respect to each other when the mask is tied about the chin of the wearer.

5. The surgical mask of claim 1 and wherein said upper mask includes reinforcing means fastened along said opposing side portions and connected at its ends to said upper tie string means and said lower tie string means for partially supporting said lower mask from said upper tie string means.

6. A surgical mask to be worn by a medical attendant, for wearing about the nose, mouth, lower face and frontal neck and upper torso of the wearer for protecting the wearer from exposure to the body fluids expelled from a patient, comprising:

an upper mask for coveting the wearer's nose, mouth and chin, said upper mask having an upper edge portion for placement across the bridge of the wearer's nose and a lower edge portion for placement under the chin of the wearer, and opposing side portions for extending about the cheeks of the face of the wearer;

an upper string means fastened to said upper mask at the upper edge portion of said upper mask with said upper string means freely extending from said upper mask for extending over the ears and about the head of the wearer for supporting the upper mask on the nose of the wearer;

a lower string means fastened to said upper mask at the lower edge portion of said upper mask, with said lower string means having end portions extending from said upper mask for extending beneath the ears and about the neck of the wearer for supporting the upper mask about the chin of the wearer;

a lower mask for covering the wearer's neck and frontal torso, said lower mask having an upper portion for placement beneath the chin of the wearer and a lower portion for placement at the frontal torso of the wearer, and opposed side portions sized and shaped for extending about the sides of the neck and upper torso of the wearer;

the upper portion of said lower mask being connected to both said lower string means and to the lower portion of said upper mask for forming a continuous shield from the nose downwardly to the torso of the wearer;

said upper portion of said lower mask extending on opposite sides of said upper mask along said lower string means farther than the lower portions of said upper mask, with the lower string means arranged for suspending the side portions of said lower mask about the opposite sides of the neck of the wearer and across the breast of the wearer to protect the front and sides of the wearer's neck and the breast of the wearer from fluids expelled from a patient.

7. A surgical mask to be worn by a medical attendant, for wearing about the nose, mouth, lower face and frontal neck and upper torso of the wearer for protecting the wearer from exposure to the body fluids expelled from a patient, comprising:

an upper mask for coveting the wearer's nose, mouth, chin and upper neck, said upper mask including a segment of sheet material formed of air permeable material to permit the wearer to breathe through the upper mask while protecting the nose and mouth of the wearer from fluids expelled from a patient and having an upper edge portion for placement across the bridge of the wearer's nose and a lower edge portion for placement under the chin of the wearer, and opposing side portions intersecting said upper edge portion and said lower edge portion for extending about the cheeks of the face of the wearer;

a lower mask for coveting the wearer's neck and frontal torso, said lower mask including a segment of sheet material formed of fluid impervious material for protecting the wearer from exposure to body fluids expelled from a patient, said lower mask having an upper edge portion for placement beneath the chin of the wearer and a lower edge portion for placement at the front torso of the wearer, and side portions sized and shaped for extending about the sides of the neck and upper torso of the wearer;

string means connected to said masks, said string means including an upper horizontal segment extending along the upper edge portion of said upper mask, a lower horizontal segment extending along the lower edge portion of said upper mask and along the upper edge of said lower mask, opposed side segments extending along the opposed side portions of said upper mask, and tie string segments extending from the intersections of said side edge portions with said upper and lower edge portions;

means connecting the lower horizontal segment of said string means and the lower edge portion of said upper mask and the upper edge portion of the lower mask;

the upper edge portion of said lower mask being of greater breadth than said upper mask and extending laterally beyond both of the opposing side portions of said upper mask;

means connecting the laterally extending upper portions of said lower mask to said tie string segments so that the tie strings support the laterally extending upper portions of said lower mask about the sides of the neck of the wearer; and pleats formed in the sheet material of said upper mask extending between said opposing side portions of said upper mask for the upper mask to expand about the chin of the wearer and for the upper edge portion of said lower mask to be drawn close to the neck of the wearer.

* * * * *